US010113738B2

(12) United States Patent
Schmitt

(10) Patent No.: US 10,113,738 B2
(45) Date of Patent: Oct. 30, 2018

(54) UNDERWATER LIGHT FITTING

(71) Applicant: Integrated Pool Product (Pty) Ltd, Muldersdrift (ZA)

(72) Inventor: Karl-heinz Schmitt, Benoni (ZA)

(73) Assignee: INTEGRATED POOL PRODUCTS (PTY) LTD., Muldersdrift (ZA)

( * ) Notice: Subject to any disclaimer, the term of this patent is extended or adjusted under 35 U.S.C. 154(b) by 0 days.

(21) Appl. No.: 15/318,174

(22) PCT Filed: Jun. 12, 2015

(86) PCT No.: PCT/IB2015/054452

§ 371 (c)(1),
(2) Date: Dec. 12, 2016

(87) PCT Pub. No.: WO2015/189812

PCT Pub. Date: Dec. 17, 2015

(65) Prior Publication Data

US 2017/0122544 A1 May 4, 2017

(30) Foreign Application Priority Data

Jun. 12, 2014 (ZA) ..... 2014/01593

(51) Int. Cl.
*F21V 31/00* (2006.01)
*F21S 8/00* (2006.01)
(Continued)

(52) U.S. Cl.
CPC ..... *F21V 31/005* (2013.01); *E04H 4/148* (2013.01); *F21S 8/036* (2013.01); *F21V 3/02* (2013.01);
(Continued)

(58) Field of Classification Search
CPC ..... F21V 31/005; F21V 3/02; F21V 3/049; F21V 23/002; E04H 4/148; F21S 8/036
See application file for complete search history.

(56) References Cited

U.S. PATENT DOCUMENTS 3,949,213 A * 4/1976 Paitchell ..... B63B 45/02 174/51
4,539,629 A * 9/1985 Poppenheimer ..... F21S 8/00 362/267
8,858,016 B2 * 10/2014 Strelchuk ..... F21S 8/06 362/184

FOREIGN PATENT DOCUMENTS

EP 2339232 A1 6/2011
FR 2968333 6/2012
(Continued)

*Primary Examiner* — David V Bruce
(74) *Attorney, Agent, or Firm* — Muncy, Geissler, Olds & Lowe, P.C.

(57) ABSTRACT

An underwater wall mounted light fitting having a sealed light source chamber and an electrical supply connection chamber including a port to sealingly engage over an electrical supply line with an array of electrical conductive connectors embedded in a dividing wall and each providing a connection terminal on opposite sides of the wall within the chambers respectively. The dividing wall is moulded around the connectors which are provided as rigid spigots with circumferential grooves to receive the moulded wall material. The connection chamber is a hollow cover with the port which includes a compression gland assembly for an electrical supply line. The dividing wall is securable against a peripheral frame provided on the lens and the frame includes a continuous flange which fits around the dividing wall. The housing is releasably securable to a wall mountable bracket. LEDs provide the light source.

11 Claims, 5 Drawing Sheets

(51) Int. Cl.

| | |
|---|---|
| ***F21V 23/00*** | (2015.01) |
| ***F21V 3/02*** | (2006.01) |
| ***F21V 3/04*** | (2018.01) |
| ***E04H 4/14*** | (2006.01) |
| *F21W 131/401* | (2006.01) |
| *F21Y 115/10* | (2016.01) |
| *F21Y 105/10* | (2016.01) |

(52) U.S. Cl.
CPC ..... *F21V 3/049* (2013.01); *F21V 23/002* (2013.01); *F21W 2131/401* (2013.01); *F21Y 2105/10* (2016.08); *F21Y 2115/10* (2016.08)

(56) References Cited

FOREIGN PATENT DOCUMENTS

| | | |
|---|---|---|
| WO | WO-98/51887 | 11/1998 |
| WO | WO-2007/144829 A1 | 12/2007 |

* cited by examiner

UNDERWATER LIGHT FITTING

FIELD OF THE INVENTION

The invention relates to a light fitting of the kind used for underwater installation in a swimming pool or Jacuzzi bath, for example. The fitting of the invention is particularly useful where an existing light fitting needs to be replaced.

BACKGROUND TO THE INVENTION

Underwater wall mounted pool lights have long since been a standard feature in swimming pools.

Known pool lights are commonly sold with a power cable sealingly secured into the housing of the light fitting. The cable is connected to a power source and installed in a semi-permanent manner between the electricity supply connection and the desired point of installation. The cable is also typically coiled into a recess in the wall at the point of installation to allow the light fitting to be moved between an underwater mounted position and a position above the level of the water.

To replace a light fitting the existing cable installation is usually left intact. This applies where the cable is fixed semi-permanently between the power source and the installation point. The alternative of replacing an existing, laid cable with a new one is too difficult and impractical.

The replacement thus requires cutting the existing cable at the old light fitting, cutting the bulk of the new light fitting cable off, stripping the free ends of both cables and joining them in a sealed manner so that water does not come into contact with the cable wires. This method is not desirable for its lack of elegance and reliability.

OBJECT OF THE INVENTION

It is an object of the invention to provide a light fitting which is convenient to install as a replacement and which has improved features to prevent ingress of water to the areas which house electrical components.

SUMMARY OF THE INVENTION

In accordance with the invention there is provided an underwater wall mounted light fitting comprising a sealed or sealable light source chamber having a lens and a sealable electrical supply connection chamber including a port to sealingly engage over an electrical supply line with a dividing wall of insulating material provided between the two compartments and an array of electrical conductive connectors embedded in the dividing wall and each providing a connection terminal on opposite sides of the wall within the chambers respectively.

The invention further provides for the dividing wall to be moulded around the connectors; for the connectors to be rigid spigots; for the spigots to have circumferential grooves at or about a mid-section to receive the moulded wall material; and for the spigots to have, at least at an end located in the connection chamber, a transverse bore adjacent to the end to receive an electrical wire with an intersecting tapped hole for a grub screw extending from the end.

Further features of the invention provide for the port to include a seal arrangement to receive and sealingly engage around an electrical supply line; and for the seal arrangement to be a compression gland assembly.

A further feature of the invention provides for the connection chamber to be provided by a hollow cover which includes the port and is removably securable to the dividing wall through an arrangement of screws with an O-ring seal located between the cover and the wall.

Further features of the invention provide for the lens to include a peripheral frame and for the dividing wall to be securable against the frame with a seal therebetween; for the frame to include a continuous flange extending away from the lens and for the periphery of the dividing wall to be slidably locatable inside the flange; and for an O-ring to be provided between the flange and the wall.

Further features of the invention provide for the housing to be releasably securable to a wall mountable bracket; and for the housing to have a radially protruding lug which fits into a groove on the inside of the bracket and a screw hole spaced apart from the lug with a screw threaded bore in the bracket corresponding to the screw hole to receive a fastening screw.

A further feature of the invention provides for the light source to be surface-mount-device (SMD) light emitting diodes (LEDs) on a printed circuit board supported in the light source chamber.

In accordance with another aspect of the invention there is provided an underwater lighting kit comprising a solar panel, a solar charge storing battery and a light fitting as defined above having an array of light emitting diodes (LEDs) as its light source.

In accordance with still another aspect of the invention there is provided an underwater wall mounted light fitting comprising a light source chamber having a lens and an electrical supply connection chamber including a port to sealingly engage over an electrical supply line, each chamber engageable to a dividing wall over a seal to provide a sealed light source compartment and a sealed electrical supply connection compartment, with an array of electrical conductive connectors extending through the dividing wall.

BRIEF DESCRIPTION OF THE DRAWINGS

These and other features of the invention will become more apparent from the following detailed description, made by way of example only, with reference to the accompanying drawings, in which.

DETAILED DESCRIPTION OF THE INVENTION

Figure 1:
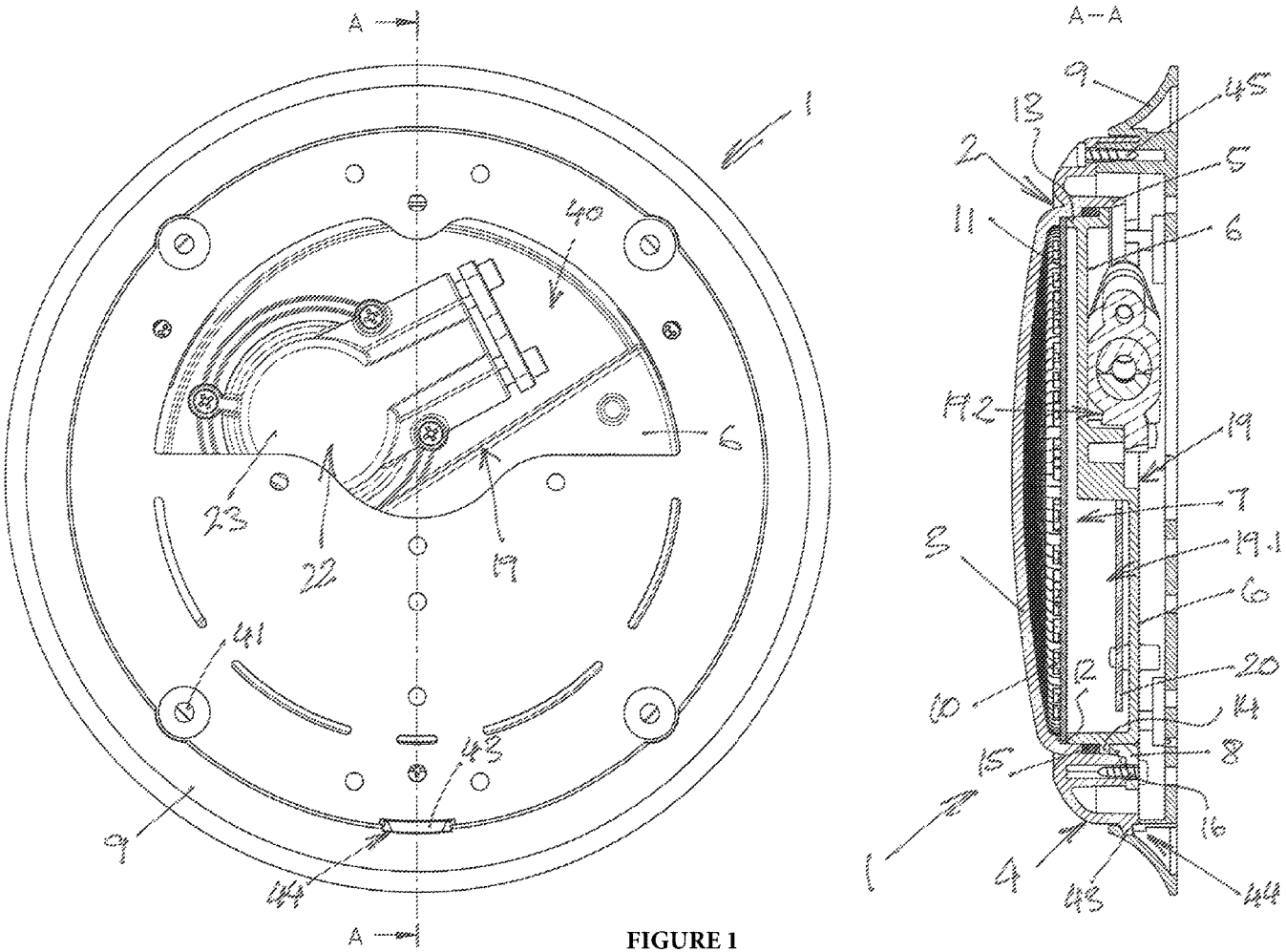
FIG. 1 shows a back side view of an underwater light fitting and wall mounting bracket and a cross section taken along line A-A.
Figure 2:
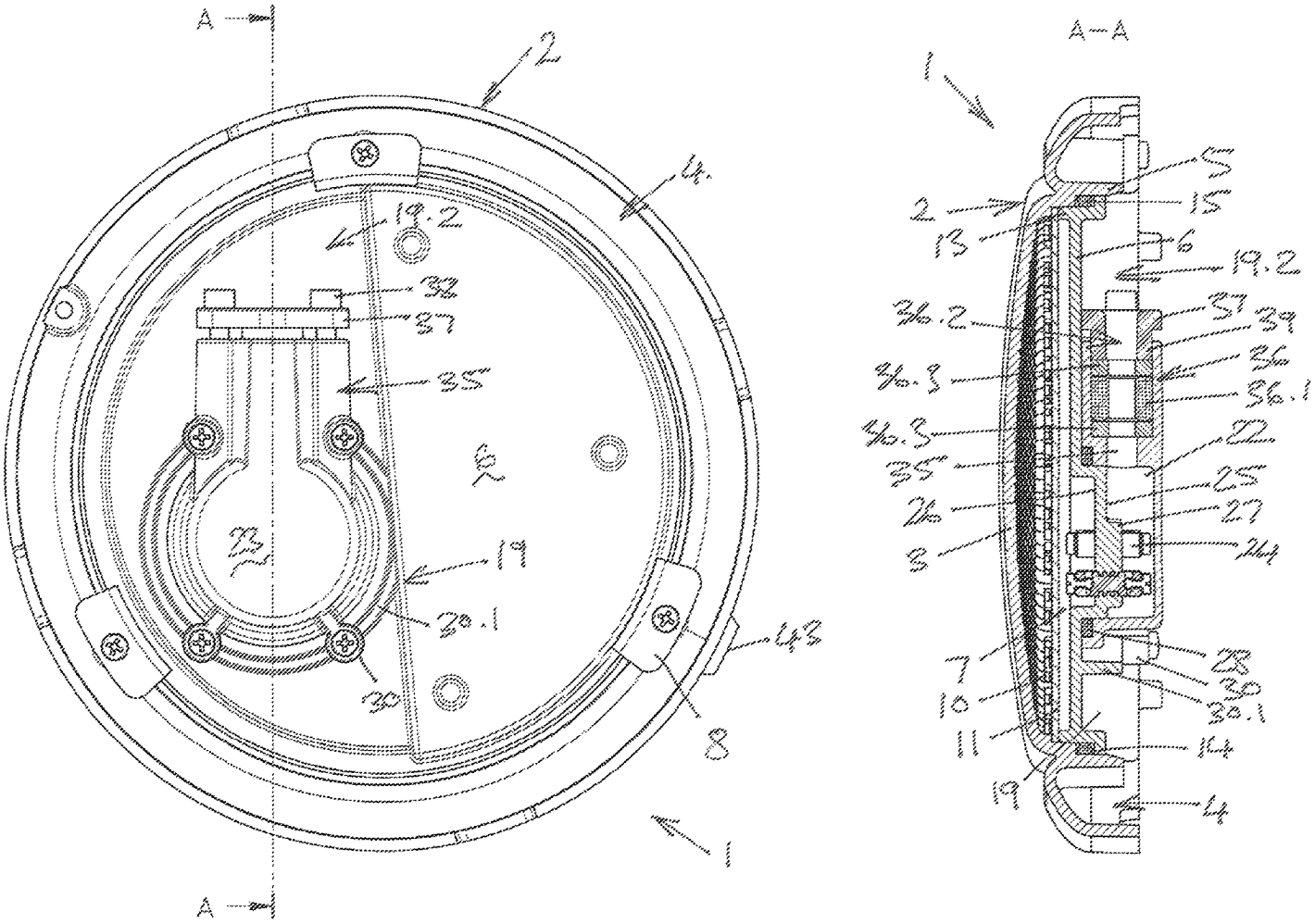
FIG. 2 shows a back side view of the underwater light fitting without the wall mounting bracket and a cross section taken along line A-A.
Figure 3:
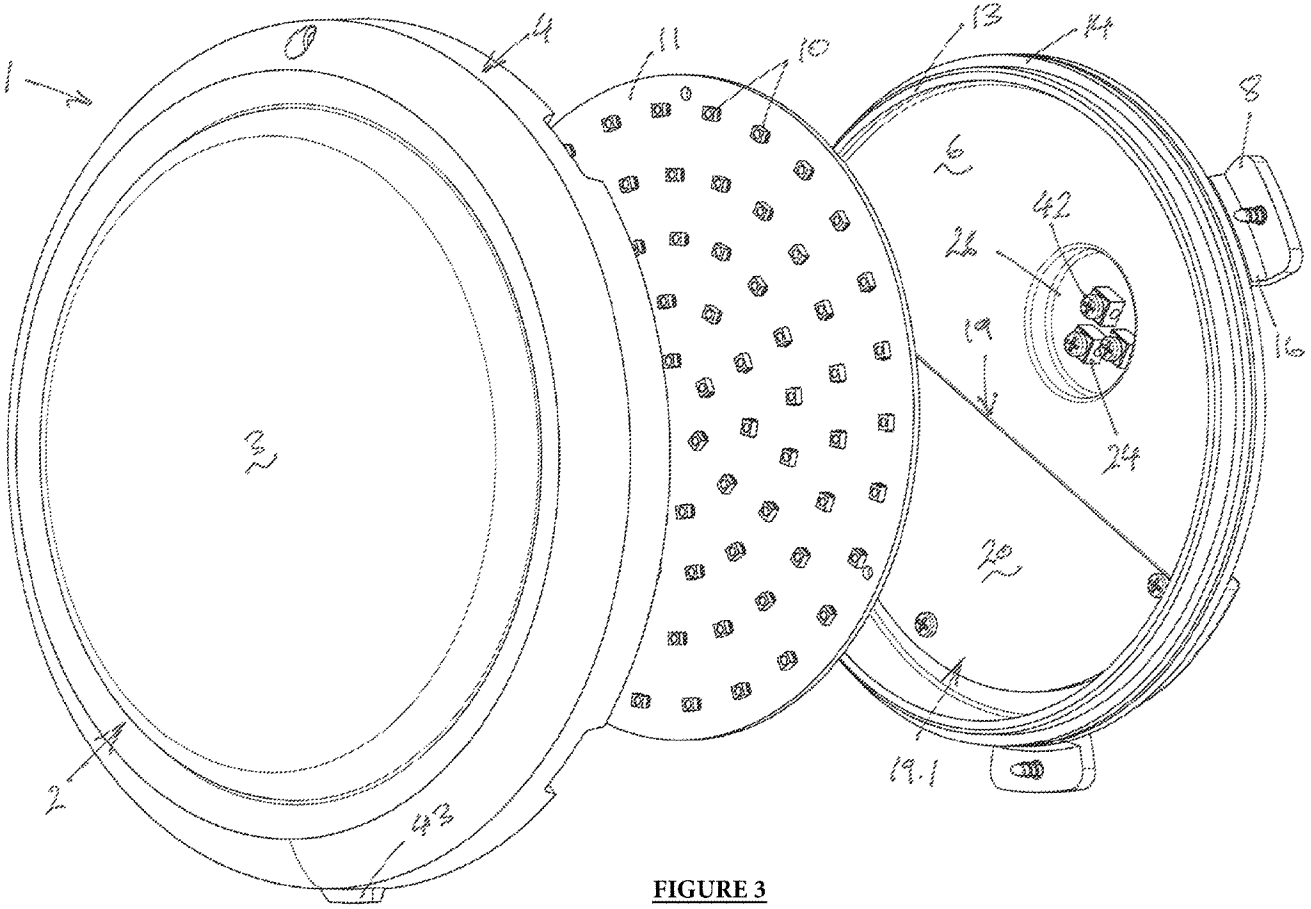
FIG. 3 shows a front side, exploded perspective view of the light fitting.
Figure 4:
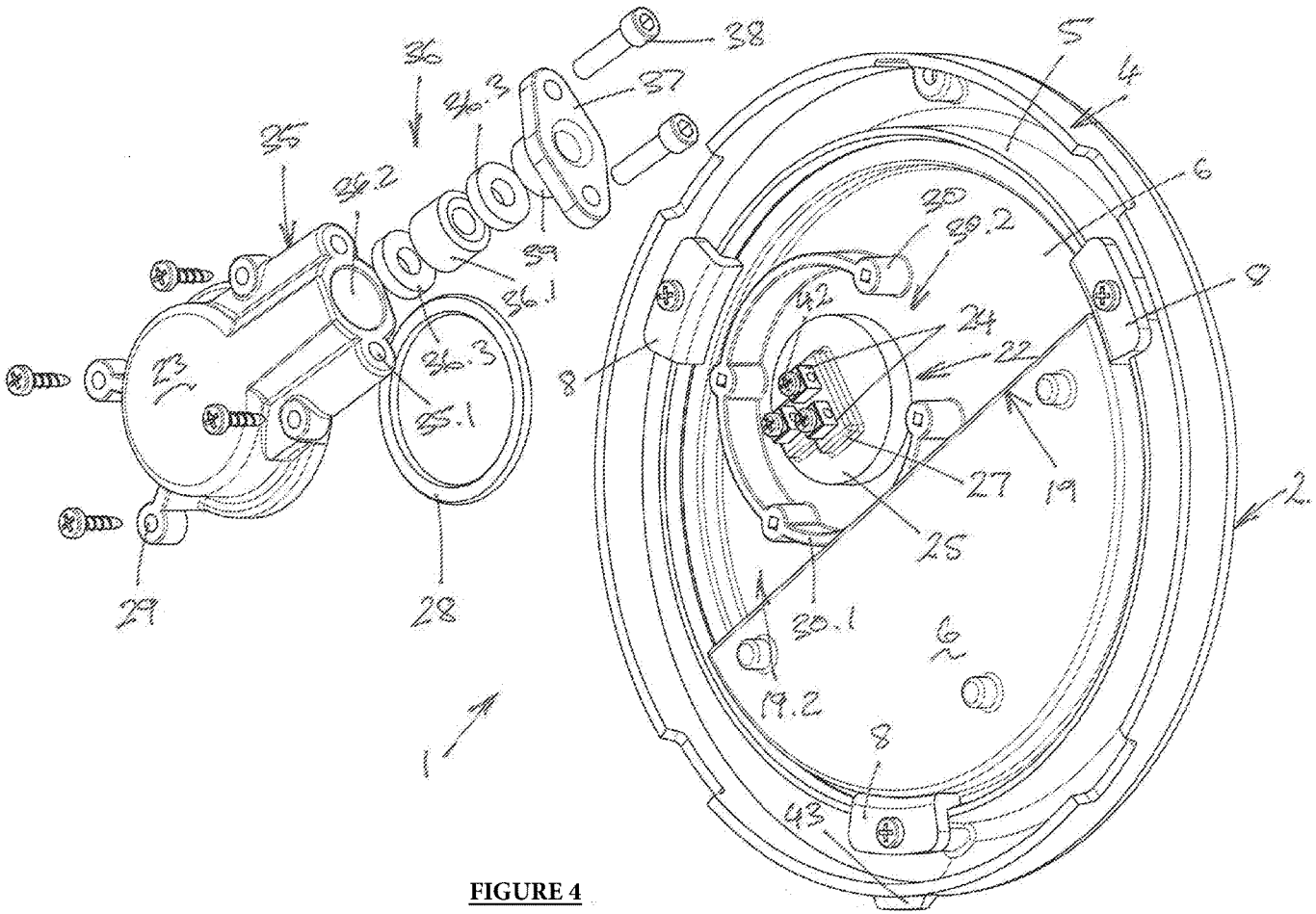
FIG. 4 shows a back side, exploded perspective view of the light fitting.
Figure 5:
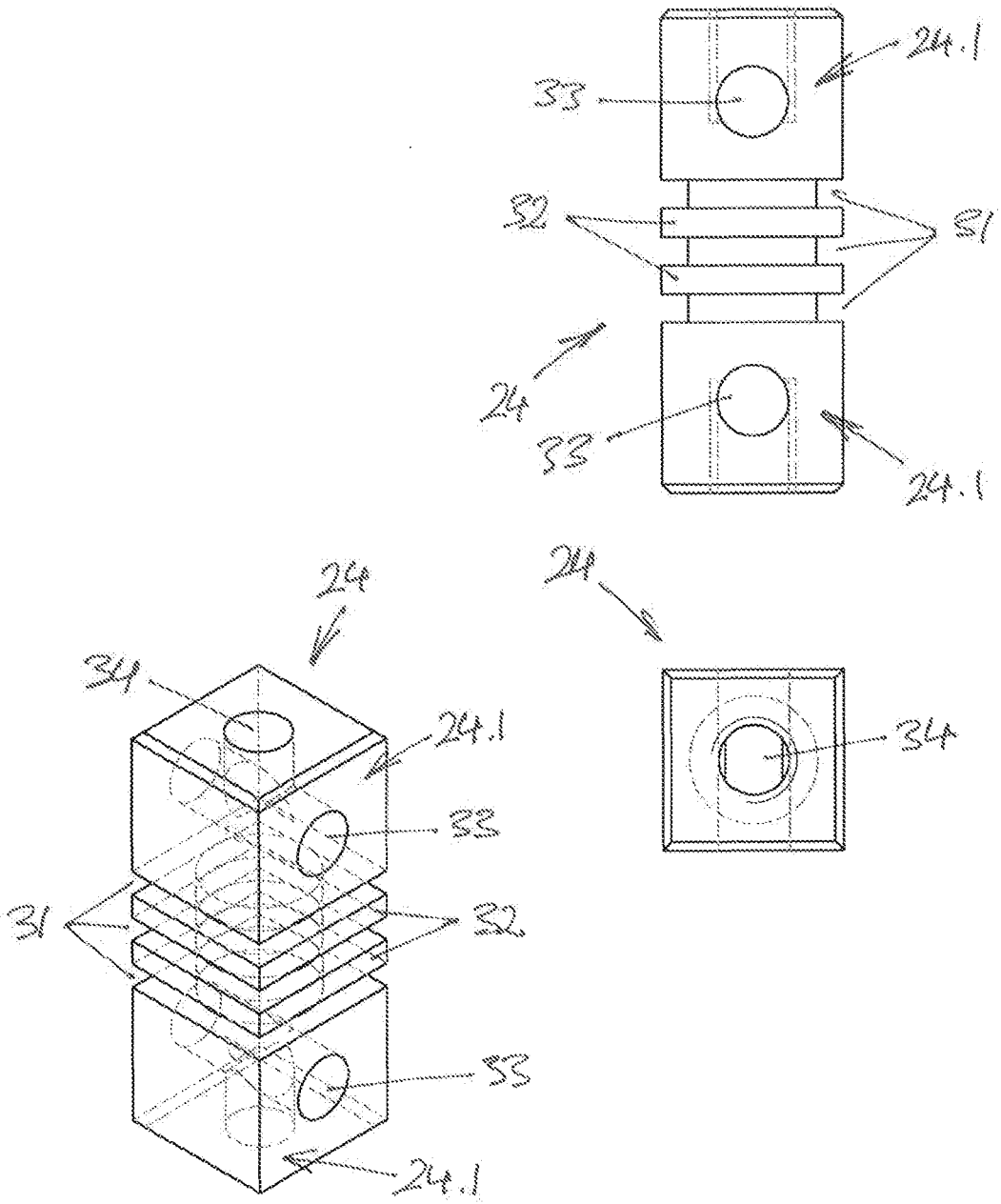
FIG. 5 shows side, end and perspective views of an electrical connector of the light fitting.

The invention provides an underwater light fitting generally indicated by reference numeral (1).

The fitting (1) comprises a housing (2) manufactured from plastics material. The front of the housing (2) comprises a circular lens (3). The lens (3) is polished for the required transparency with a diffuser pattern provided on the inside and moulded integrally with a circumferential frame (4).

The frame (4) includes a rearwardly extending continuous outer flange (5) located about the periphery of the lens (3).

A dividing wall (6) is sealingly locatable inside the flange (5) to provide a light source chamber (7) behind the lens (3). The frame (4) is configured to receive three clips or L-shaped lugs (8) which hold the dividing wall (6) in place and for releasably engaging a wall mounting bracket (9) which will be secured to a swimming pool wall.

In an alternative embodiment, the L-shaped lugs (8) will be moulded integrally to the dividing wall (6).

The lens (3) forms the outer component of the sealable light source chamber (7). The chamber (7) includes a light source in the form of an array of light emitting diodes (LEDs) (10) fixed to a front surface of a round mounting board (11).

In this particular embodiment, surface-mount-device (SMD) LEDs (10) are used attached directly to a printed circuit (PC) board (11). The SMD LEDs have a lower energy consumption than standard LED's and generate significantly less heat. This has the advantage that you can use them in enclosed areas without the need for heat sinks. They also have the advantage that they can be placed and secured to the PC board with standard PC board technology. This process is highly automated and therefore less expensive.

The front of the PC board (11) abuts axially against a shoulder (12) provided at the periphery of the lens (3) on the inside of the chamber (7). An outer edge of the PC board (11) fits in sliding engagement into the flange (5) of the frame (4).

The dividing wall (6) is provided of insulating plastics material and fits over the PC board (11) into the outer flange (5) in sliding engagement. The wall (6) has a planar edge provided on a circular inner flange (13). A peripheral rib (14) which extends radially from the inner flange (13) is provided as a close fit on the inside of the outer flange (5) formed on the frame (4).

The spacing of the rib (14) from the front edge of the inner (5) flange wall is selected for compression of an O-ring (15) in the space provided by the inner (13) and outer (5) flanges and against the back of the PC board (11) which abuts the shoulder (12) in the assembly (1).

The L-shaped lugs (8) are each provided with a lip (16) which is locatable between the inner (13) and (5) outer flanges. The lugs (8) have screw holes for fastening screws (18) which fit into threaded bores spaced apart around the outer flange (5). With the lugs (8) fastened in place, the lips (16) bias the backside of the rib (14) to secure the dividing wall (6) in the assembled position and compress the O-ring (15). The compression of the O-ring (15) provides for radial sealing between the diving wall (6) and the frame (4).

The circular dividing wall (6) has a linear step (19) formed between two points on its circumference near a central region.

The inner flange (13) and wall (6) provide a semi-circular recess (19.1) inside the light source chamber (7) behind the PC board (11) into which a complementarily shaped and sized driver board (20) is secured using three screws.

An electrical connection chamber (22) is provided against the dividing wall (6), to the other side (19.2) of the step (19). The chamber (22) is formed by a dome-shaped, hollow cover (23) securable to the dividing wall (6).

An array of three triangularly oriented electrical conductive connectors (24) are moulded into the dividing wall (6). The dividing wall (6) is moulded with a mound (25) inside the connection chamber (22) and a corresponding depression or trough (26) inside the light source chamber (7). It is across this region of the wall (6) that the connectors (24) extend. On the rear side of the wall (6) the material is moulded proud to provide a T-shaped platform (27) around the connectors (24) inside the connection chamber (22).

The cover (23) is complementarily shaped and sized to fit over an O-ring (28) located around the mound (25) in sealed engagement with the dividing wall (6). The cover (23) includes four spaced apart screw holes (29) arranged about its periphery. The wall (6) includes four protruding sleeves (30) each provided with sockets for receiving self-tapping screws inserted through the holes (29) to secure the cover (23) down over the O-ring (28). The sleeves (30) are connected by three flanges (30.1) leaving a space (30.2) open between two adjacent sleeves (30). The space (30.2) serves to accommodate an electrical connection port (35) formed onto the cover (23) which will be described below.

Each connector (24) is located transversely through a plane of the wall (6). Terminals (24.1) at either end of each connector (24) protrude from both sides. Each connector (24) accordingly has an end providing a connection terminal (24.1) exposed into the electrical supply chamber (22) and the light source chamber (7). The arrangement of the wall (6), with the connectors (24) located inside the trough (26) within the light source compartment (7), avoids any contact between the metallic components and the PC board (11) during assembly. The internal wiring will run from the trough (26) across the step (19) to the electronic components on the driver board (20) which are in turn wired to the LEDs (10).

The connectors are each formed from extruded brass as a rigid spigot (24) in the shape of a bar. The connector (24) has three parallel circumferential grooves (31) formed around its mid-section. The sides of the grooves (31) are perpendicular to the surface of the connector (24) forming two transverse flanges (32) of square cross-section.

The end portions providing the terminals (24.1) on either side of the grooves (31) have transverse bores (33) providing electrical wire sockets with an intersecting tapped hole (34) extending axially from each end into the bores (33).

A port (35) extends through the cover (23) from inside the connection chamber (22). The port (35) includes a seal arrangement (36) for receiving and sealingly engaging around an electrical supply line (not shown). The seal arrangement is provided by a compression gland assembly (36). A compression gland (36.1) is located inside a passage (36.2) between two spacers (36.3). A pair of screw threaded sockets (35.1) is provided on either side of the passage (36.2).

A clamping plate (37) receives two compressing screws (38) and has an annular spigot (39) which is biased against the gland assembly (36) on tightening of the screws (38) to effect compression of the gland (36.1).

In use, an old light fitting is dismounted from the swimming pool wall and lifted to the poolside surface. The existing electrical supply cable is cut at a point near the old light fitting.

The cable is passed through an opening (40) in the wall mounting bracket (9) which will then be secured to the swimming pool wall. This will preferably be done using waterproof glue provided with the fitting. (The bracket (9) also has four holes (41) providing a screw-mounting option.) The opening (40) in the bracket (9) will be located over a recess in the wall which was located behind the removed fitting.

The end insulation is stripped from the cable and the exposed wires are inserted through the port (35) into the cover (23). At this point the cover (23) is not secured to the dividing wall (6).

The exposed wires are inserted into the transverse bores (23) at the connector terminal ends. Grub screws (42) are fastened through the tapped holes (34) to secure the wires in position.

The gland assembly (36) is clamped to seal over the length of cable where it passes through the port (35) into the electrical supply connection chamber (22) with the exposed wires secured in contact with the electrical conductive connectors (24). The cover (23) is then tightened over the O-ring (28) against the dividing wall (6) to seal the connection chamber (22).

Alternatively, where the light fitting (1) is to be included as part of a new construction, (swimming pool or other water feature) or where an existing cable is damaged and needs to be replaced, a new cable will be installed as required. The light fitting (1) may be supplied with a cable already connected into a sealable unit or a new cable will be connected to the light fitting (1) in the same manner as described above.

The fitting (1) is then lowered into the water and mounted on the wall. The bracket (9) provides a mounting socket for engagement with the frame (4) of the housing (2). The frame (4) has a peripheral lug (43) which fits into a corresponding groove (44) formed on the bracket (9). With the lug (43) located inside the groove (44), the housing (2) is pivoted into an installed position. A screw (45) is fitted through an opening in the frame (43) located opposite the lug (43) and tightened into a screw threaded socket to complete the installation.

The slack cable is fed through the opening (40) and into the recess in the wall (where such a recess is part of the existing swimming pool construction) as the housing (2) is fitted to the bracket (9).

The surface mounted light fitting (1) of the invention is however also suited for installation in swimming pools that have been constructed without any lights (and the recesses in the pool wall, as referred to). In this case, the slack cable (up to about 1 meter long) can be coiled up in the space between the dividing wall (6) and the wall mounting bracket (9). Therefore no recess is required in the wall to accommodate the excess length of cable. The arrangement allows for use of the fitting (1) on above ground swimming pool constructions.

The invention also provides for the LED light fitting to be included as part of a kit with alternative electricity supply equipment. The kit will include a suitable solar panel and the necessary electrical components for connection to a battery which will store the solar generated charge. In this case, the light fitting cable will be wired to the battery as a power supply. The kit eliminates the need for a transformer from the mains electricity supply.

The invention provides a fitting (1) which is convenient to install and avoids the usual measure of an external connection and water proofing of cable ends in the electrical supply line.

The electrical connection chamber (22) provides a first seal to the ingoing electrical connections. Even in the event of water ingress past this seal, the fitting will, in the case of the LED embodiment, continue to function (due to the nature of the current supply).

The arrangement of the embedded connectors (24), which bridge the dividing wall (6), form a second seal that is provided as an integral component of the fitting construction. The seal so established should outlast the lifetime of the LEDs (10) and/or remainder of the fitting components. (The seal between the light source chamber (7) and the dividing wall (6) will be provided with the appropriate waterproof rating and the fitting will be supplied with this intact.)

A person skilled in the art will appreciate that a number of alternative embodiments other than that described fall within the scope of the invention.

Furthermore, although the fitting is designed for underwater use, it will be appreciated that it will also find application in high moisture environments, such as saunas, that may be below its specification.

The invention claimed is:

1. An underwater wall mounted light fitting comprising a sealed or sealable light source chamber having a lens that includes a peripheral frame with a continuous outer flange extending rearwardly, away from the lens and a sealable electrical supply connection chamber formed by a removably securable hollow cover including a port to sealingly engage over an electrical supply line, with a dividing wall of insulating material provided between the two chambers with a periphery of the dividing wall slidably locatable inside the outer flange, the dividing wall having a step formed between two points on its circumference near a central region providing, to one side of the step, a recess inside the light source chamber with the cover of the electrical connection chamber securable to the dividing wall on the other side of the step over an array of electrical conductive connectors embedded in the dividing wall each providing a connection terminal on opposite sides of the dividing wall within the two chambers respectively.

2. A light fitting as claimed in claim 1 in which the light source comprises surface-mount-device (SMD) light emitting diodes (LEDs) on a printed circuit board supported in the light source chamber with an LED driver board located inside the recess of the light source chamber.

3. A light fitting as claimed in claim 1 in which the dividing wall has an inner flange with a peripheral rib that extends radially from the inner flange and is provided as a close fit to an inside of the outer flange of the frame for compression of an O-ring between the inner flange and outer flange.

4. A light fitting as claimed in claim 1 in which the dividing wall is moulded with a mound inside the connection chamber and a corresponding depression inside the light source chamber and the connectors located inside the depression within the light source chamber.

5. A light fitting as claimed in claim 1 in which the connectors are rigid spigots and the dividing wall is moulded around the connectors which have circumferential grooves at or about a mid-section to receive moulded material of the dividing wall.

6. A light fitting as claimed in claim 5 in which the spigots have, at least at an end located in the connection chamber, a transverse bore adjacent to the end to receive an electrical wire with an intersecting tapped hole for a grub screw extending from the end.

7. A light fitting as claimed in claim 1 in which the port includes a compression gland assembly to receive and sealingly engage around an electrical supply line.

8. A light fitting as claimed in claim 1 in which the hollow cover is complementarily shaped and sized to fit over an O-ring and removably securable in sealed engagement to the dividing wall through an arrangement of screws with the cover including spaced apart screw holes arranged about its periphery and the dividing wall including protruding sleeves each provided with sockets for receiving the screws inserted through the screw holes to secure the cover down over the O-ring located between the cover and the dividing wall.

9. A light fitting as claimed in claim 8 in which a space open between two adjacent sleeves serves to accommodate the electrical connection port formed onto the cover.

10. A light fitting as claimed in claim 1 in which the housing is releasably securable to a wall mountable bracket.

11. A light fitting as claimed in claim 9 in which the housing has a radially protruding lug which fits into a groove on the inside of the bracket and a screw hole spaced apart from the lug with a screw threaded bore in the bracket corresponding to the screw hole to receive a fastening screw.

* * * * *